United States Patent [19]

Karp

[11] 4,409,519

[45] Oct. 11, 1983

[54] TWT SLOW-WAVE STRUCTURE ASSEMBLED FROM THREE LADDER-LIKE SLABS

[75] Inventor: Arthur Karp, Palo Alto, Calif.

[73] Assignee: Varian Associates, Inc., Palo Alto, Calif.

[21] Appl. No.: 287,953

[22] Filed: Jul. 29, 1981

[51] Int. Cl.[3] ..... H01J 25/34

[52] U.S. Cl. ..... 315/3.5; 315/3.6; 315/39.3; 333/257

[58] Field of Search ..... 315/3.5, 3.6, 39.3; 333/257

[56] References Cited

U.S. PATENT DOCUMENTS

| | | | |
|---|---|---|---|
| 2,970,242 | 1/1961 | Jepsen | 315/3.6 |
| 3,400,297 | 9/1968 | Miyamoto | 315/3.5 |
| 3,906,300 | 9/1975 | Tran | 315/3.5 |

*Primary Examiner*—Saxfield Chatmon, Jr.
*Attorney, Agent, or Firm*—Stanley Z. Cole; Peter J. Sgarbossa; Richard B. Nelson

[57] ABSTRACT

This invention concerns a slow-wave circuit which is electrically equivalent to the well-known folded-waveguide or coupled-cavity circuit with staggered coupling slots. The central portion of the circuit is a metallic ladder. The ladder rungs are wide and flat to form the equivalent of flat cavities. The rungs have axially aligned holes thru their centers for beam passage. A pair of coupling ladders are joined to opposite sides of the central ladder. They have apertures or recesses spaced at twice the pitch of the central ladder; the recesses are aligned to provide a coupling duct between each pair of adjacent cavities, and cavity-closing walls at the ends of the pair. The coupling recesses in the two coupling ladders are staggered by the cavity pitch so that the coupling ducts are on alternating sides of the cavities.

5 Claims, 7 Drawing Figures

FIG. 1A
PRIOR ART
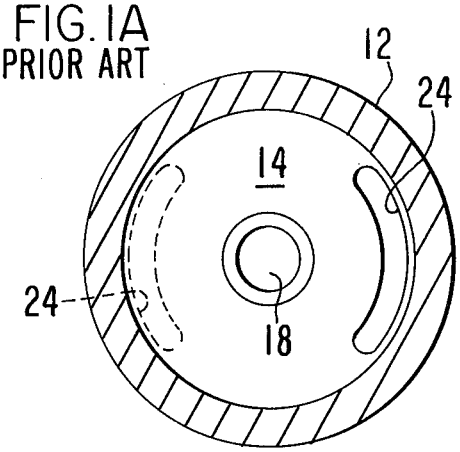
FIG. 1B
PRIOR ART
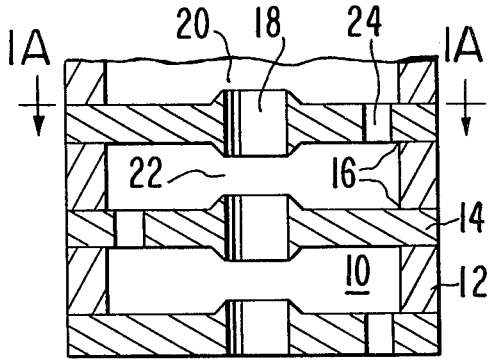
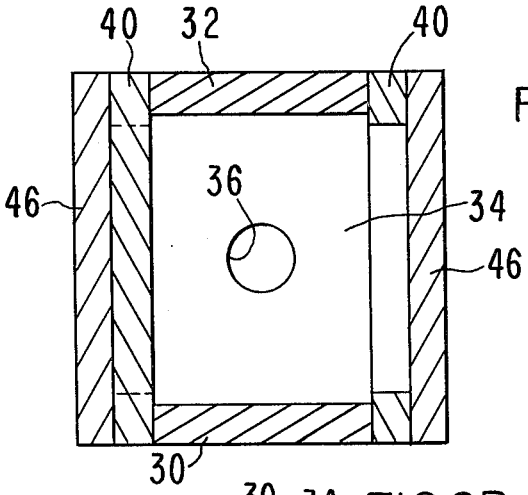
FIG. 2A
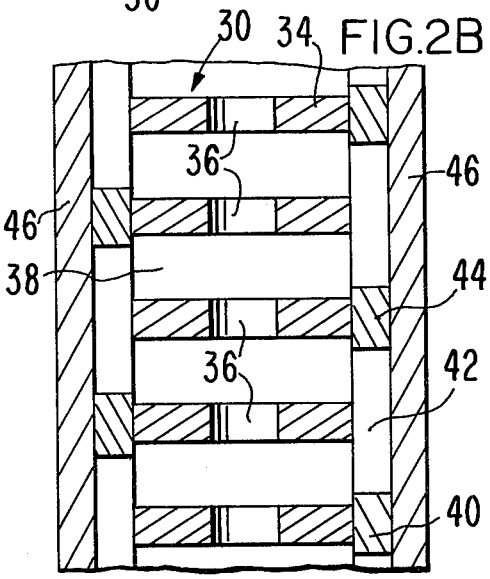
FIG. 2B
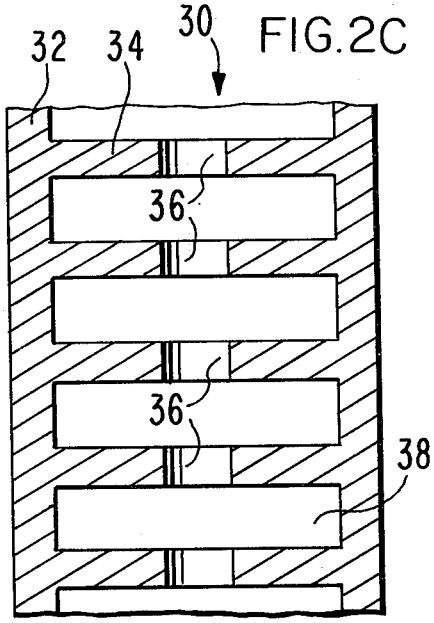
FIG. 2C

TWT SLOW-WAVE STRUCTURE ASSEMBLED FROM THREE LADDER-LIKE SLABS

The Government has rights in this invention pursuant to Contract F30602-79-C-0172 awarded by the Department of the Air Force.

DESCRIPTION

FIELD OF THE INVENTION

The invention pertains to slow-wave circuits as used in traveling-wave tubes (TWTs) for interaction with a linear beam of electrons. For generating high power at very high frequencies (tens of gigahertz), a most useful circuit is the so-called "folded waveguide" or "stagger-coupled cavity" circuit. The invention pertains to an electrical equivalent of this circuit having improved structural and electrical features.

BRIEF DESCRIPTION OF THE DRAWINGS

FIG. 1A is a section perpendicular to the axis of a prior-art slow-wave circuit.

FIG. 1B is an axial section of the circuit of FIG. 1A.

FIG. 2A is a section perpendicular to the axis of a circuit embodying the invention.

FIGS. 2B and 2C are axial sections of the circuit of FIG. 2A.

PRIOR ART

Figure 3:
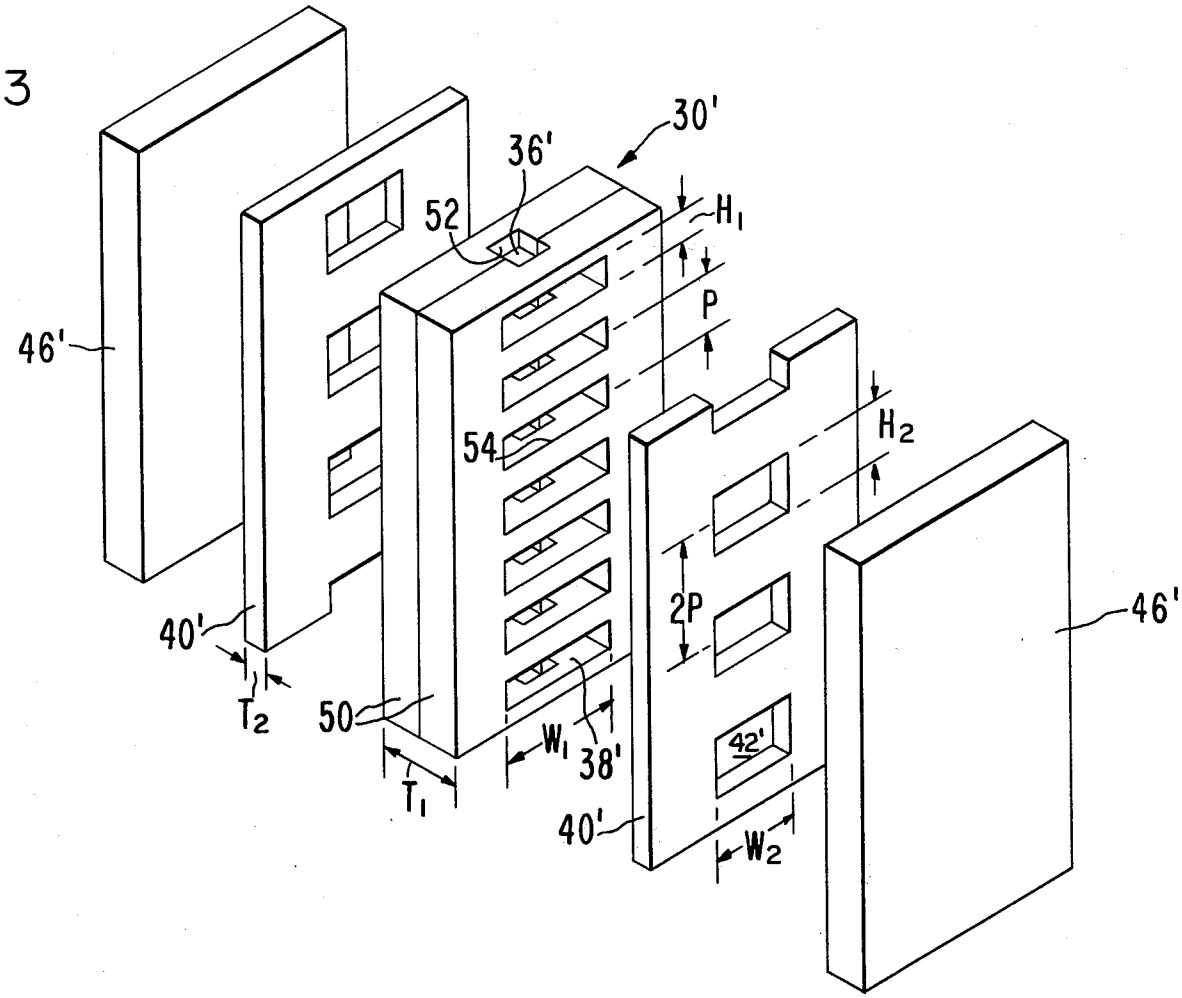
FIG. 3 is an exploded isometric sketch of the circuit of FIGS. 2.

The coupled-cavity slow-wave circuit has been widely used in high-power TWTs of moderate bandwidth. At low frequencies, such as below 20 GHz, a typical construction of such a circuit is illustrated by FIGS. 1. The interaction cavities 10 are formed by spacer rings 12 as of copper, stacked alternating with end plates 14, also copper. The assembly is bonded together by brazing at joints 16 with a silver-copper or gold-copper alloy to form a vacuum tight envelope. Each plate 14 has an axial aperture 18 for passage of an electron beam (not shown) which interacts with the axial component of the rf electric field in the cavities. Aperture 18 is often lengthened axially by protruding lips 20 which confine the electric field to a shorter axial gap 22, thereby raising the interaction impedance and beam coupling factor of the cavity. Adjacent cavities 10 are mutually coupled by a coupling slot 24 in each end plate 14, located near the outer edge of cavity 10 where the rf magnetic field is highest, thus providing coupling by mutual inductance. Alternate coupling slots 24 are staggered on opposite sides of cavities 10. This provides the "folded waveguide" characteristic which provides a large interaction bandwidth. With this type of coupling, the fundamental circuit wave is a backward wave. The tube is operated in the first space-harmonic wave mode, which is a forward wave so that near-synchronous interaction with a constant-velocity electron beam can be achieved over a relatively wide band of frequencies.

The prior-art circuit of FIGS. 1 is satisfactory at low frequencies. However, when built for frequencies such as 20 GHz and higher, it develops serious difficulties. The many parts are tiny and costly to machine accurately. The axial spacing is subject to cumulative errors in stacking. When the stacking errors are in the periodic spacing of elements 14, they deteriorate the bandpass characteristic and impedance of the circuit. When there are errors of alignment on the axis, they can cause beam interception with consequent power loss or tube failure.

Also, the brazed joints 16 can cause two kinds of trouble. If the braze alloy does not flow completely, there is a crack which can present a high resistance to the circulating cavity current which must cross the crack. On the other hand, if the braze alloy flows out on the cavity inside surface, the high electrical resistance of common braze alloys increases the attenuation of the circuit. If the alloy forms a fillet across the corner, the cavity volume is decreased, thereby detuning the cavity resonance and impairing circuit impedance and bandwidth. Thus, if said joints cannot be avoided altogether, at least one should reduce their number and length and locate them where circulating current crossing them is small.

DESCRIPTION OF THE PREFERRED EMBODIMENTS

FIGS. 2 illustrate a structure embodying the invention which has greatly improved mechanical and electrical characteristics and which can be more easily manufactured to precise tolerances. The structure comprises a unitary metallic ladder element 30 consisting of a pair of side extensions 32 joined together by an array of transverse rungs 34. At the center of each rung 34 is an axially aligned aperture 36. The transverse spaces 38 between rungs 34 form cavities analogous to cavities 10 of FIG. 1. They support the electromagnetic wave of the circuit which interacts with the beam of charged particles such as electrons which travel through aperture 36.

Interaction element 30 is made of a unitary piece of metal such as copper. Spaces 38 are opened as by electrical discharge machining (EDM). Their spacing can thus be tightly controlled and is not dependent on any stacking of parts. Roughly half of the surface rf current circulating in cavities 38 flows on unitary metal surfaces rather than across any bonded joints. Beam apertures 36 may also be formed by EDM with a long straight electrode.

The open sides of cavities 38 are selectively closed by bonding a pair of ladder coupling elements 40 to the sides of interaction ladder 30. Each side coupling element 40 is a unitary metallic slab containing a ladder array of coupling apertures 42 axially spaced with a pitch twice that of rungs 34 of interaction ladder 30. Coupling elements 40 are axially aligned such that each coupling aperture 42 bridges across two successive interaction cavities 38. Rungs 44 of coupling ladder 40 are bonded to rungs 34 of interaction ladder element 30 on one side of each said rung 34. Apertures 42 thus form the analog of coupling slots 24 in the prior-art circuit of FIG. 1.

The two coupling elements 40 are aligned so that coupling apertures 42 are axially staggered by the pitch of interaction rungs 34. Thus, coupling apertures 42 alternate at opposite sides of cavities 38 to form a "folded waveguide" structure.

To complete the vacuum envelope and electrically enclose coupling apertures 42, a pair of closure slabs 46 are sealed across the outsides of coupling ladders 40. All five members are bonded together as by brazing or sintering. The braze joints intercept only a part of the total circulating rf wall current, so that the resulting structure has relatively low attenuation.

FIG. 3 shows a somewhat modified form of a circuit electrically equivalent to that of FIGS. 2. The principal difference is that interaction ladder member 30' is made of two unitary mirror-image halves 50. As before, arrays of transverse cavity slots 38' are formed in ladder members 50. Each beam aperture 36' is formed by a pair of opposing notches 52 in the aligned rungs 54 of half-ladders 50. The advantage of this construction is that notches 52 may be machined with great precision, which is hard to achieve when machining a long straight hole as in FIGS. 2. Beam apertures 36' may be square as shown, or cylindrical—for a cylindrical beam in either case.

Again, the assembled members are bonded together as by brazing or sintering. Due to the mirror-image symmetry of interaction ladder 30', being only partially perturbed by the staggered coupling slots, there are only small circulating currents across the junction of its two halves 50. The quality of the bonding is thus not critical.

Figure 4:
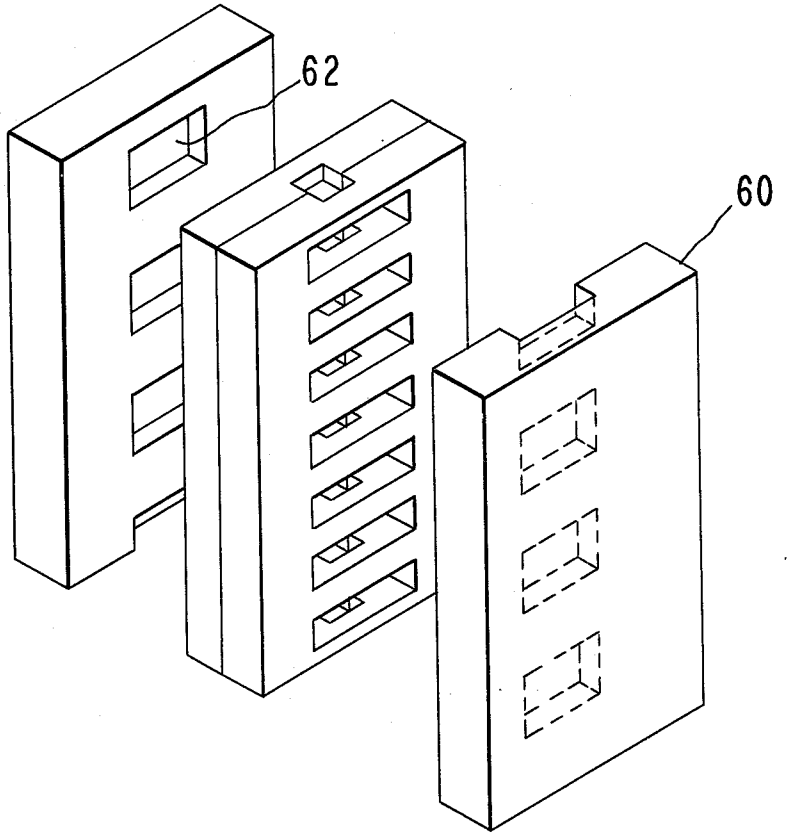
FIG. 4 is an exploded isometric sketch of a modification of the circuit of FIG. 3.

FIG. 4 shows a slightly different embodiment. The functions of coupling ladders 40' and cover slabs 46' are combined in a pair of closed coupling ladders 60. The coupling apertures are formed by depressions 62 penetrating only part way through over slabs 46'. They may be formed by EDM erosion to a controlled depth, by coining, or by photoetching, for example. The complete ladder structure is assembled as before by brazing or sintering the set of slabs. The assembled structure is exactly equivalent to that of FIGS. 2 and 3 but has fewer parts and still fewer joints.

The spirit of this invention is not limited by the imposition or omission of restrictions on the relations among the dimensions P, $H_1$, $H_2$, $W_1$, $W_2$, $T_1$ and $T_2$ of FIG. 3. However, it can be shown, for example, that adopting $H_1=P/2$, approximately, is conducive to maximizing the TWT amplifier gain. It has also been shown experimentally that adopting $W_2=W_1$ and $H_2=P$ is conductive to maximizing the amplifying bandwidth. In this case, the frequencies demarcating the edges of the circuit passband are easily calculated, to expedite a design for a given application. Again in this illustrated case, making $T_2$ slightly less than $T_1/2$ is found to be conducive to maximizing bandwidth.

The above embodiments are intended to be illustrative and not definitive. Many other variations of the invention will become apparent to those skilled in the art. The invention is to be limited only by the following claims and their legal equivalents.

I claim:

1. A slow wave circuit comprising:

a first unitary elongated metallic ladder-like interaction element, said element including a pair of parallel spaced axially-extending longitudinal members, and an array of rung members connecting said longitudinal members;

said longitudinal and rung members defining apertures in said element, said apertures being spaced from each other by a periodic pitch;

a pair of unitary elongated metallic side coupling elements, each having an array of axially extending recesses, said recesses being spaced from each other by twice said periodic pitch;

said pair of side elements being bonded to opposite sides of said interaction element such that each of said recesses bridges two successive apertures of said interaction element;

said recesses in one of said side elements being axially offset by said pitch with respect to said recesses in the other of said side elements, such that successive apertures are connected via said recesses on alternating sides of said apertures.

2. The circuit of claim 1 wherein said rungs are perforated by axially aligned openings for passage of a beam of charged particles.

3. The circuit of claim 1 wherein said recesses penetrate through said side coupling elements and further comprising a pair of closure members bonded to said side coupling members to cover the sides of said recesses opposite said interaction element.

4. The circuit of claim 1 further comprising a second unitary, metallic interaction element formed as a mirror image of said first interaction element, and an array of axially aligned grooves in one side of said rungs, said interaction elements being disposed so that their rungs are axially aligned and said grooves face each other to form passageways for passage of a beam of charged particles.

5. The circuit of claim 1, wherein said recesses within side elements define protruding ridge portions between said recessess, and each of said ridge portions are bonded to a respective one of said rungs.

* * * * *